US005307562A

United States Patent [19]

Denlinger et al.

[11] Patent Number: 5,307,562

[45] Date of Patent: May 3, 1994

[54] METHOD FOR MAKING CONTACT

[75] Inventors: Keith R. Denlinger, Lancaster; John M. Myer, Millersville, both of Pa.

[73] Assignee: The Whitaker Corporation, Wilmington, Del.

[21] Appl. No.: 972,657

[22] Filed: Nov. 6, 1992

[51] Int. Cl.[5] ..... H01R 43/04

[52] U.S. Cl. ..... 29/882; 29/885; 439/697

[58] Field of Search ..... 29/882, 885, 852, 862, 29/876

[56] References Cited

U.S. PATENT DOCUMENTS

| | | | |
|---|---|---|---|
| 4,072,394 | 2/1978 | Waldron et al. | 439/697 |
| 4,120,556 | 10/1978 | Waldron et al. | 29/882 X |
| 4,262,987 | 4/1981 | Gallusser et al. . | |
| 4,397,086 | 8/1983 | Bickos et al. | 29/885 X |
| 4,434,552 | 3/1984 | Brush, Sr. et al. | 29/876 |
| 4,685,761 | 8/1987 | Locati | 29/876 X |
| 4,780,097 | 10/1988 | Piscitelli | 439/882 X |
| 4,807,358 | 2/1989 | Dechelette et al. | 29/876 X |
| 4,998,086 | 3/1991 | Kourinsky et al. | 337/255 |
| 5,067,916 | 11/1991 | Denlinger et al. | 29/885 X |

FOREIGN PATENT DOCUMENTS

| | | | |
|---|---|---|---|
| 3435568 | 4/1986 | Fed. Rep. of Germany | 29/885 |
| 1026212 | 6/1983 | U.S.S.R. | 29/885 |

*Primary Examiner*—Carl J. Arbes
*Attorney, Agent, or Firm*—Bruce J. Wolstoncroft

[57] ABSTRACT

Two-piece socket contact assemblies and methods for manufacturing these assemblies are provided. The manufacturing process includes providing a blank strip of indefinite length, piercing the strip to provide a plurality of apertures, profiling a contact body shape along at least an edge portion of the blank to form precursors of a contact body, forming the precursors into a predetermined configuration, plating these precursors, and thereafter assembling them with a coaxially disposed sleeve.

15 Claims, 5 Drawing Sheets

METHOD FOR MAKING CONTACT

FIELD OF THE INVENTION

This invention relates to contact assemblies useful for providing electrical connections in automotive and other applications, and especially, to continuous processes for making such contact assemblies.

BACKGROUND OF THE INVENTION

Electrical connectors for use in automotive, industrial, and military applications often include connector housings having a plurality of signal contact wires and contacts disposed therein. In order to promote flexibility and ease in rendering these connections, the contacts often include receptacles and pins which can be mated in a matter of seconds to provide electrical continuity.

There are at least two current challenges to electrical connector manufacturers that have gathered the most attention of late: cost reduction and reliability. The art is focusing upon new and more efficient manufacturing processes for producing large quantities of these receptacles and pin contacts at the lowest possible cost. Additionally, new and better contact designs are being targeted to achieve better conductivity, greater forgiveness to alignment problems, and higher strength. Connector elements are often mishandled and subjected to sever environmental and mechanical stresses. Mis-sizing of pins within smaller receptacles has often resulted in damage to the contacts and unreliable connections. Misalignment of any of the constituent portions of these connectors can also result in bending of the contacts and failure of the wiring. Finally, care must be taken in order to reduce corrosion from moisture, as well as the development of interfering oxidation layers on conductive surfaces. Accordingly, there remains a need for a more continuous and reliable process for manufacturing these components in the shortest amount of time. There also remains a need for components which resist deformation and are highly reliable in service.

SUMMARY OF THE INVENTION

This invention provides continuous processes for manufacturing contact assemblies. These processes are substantially continuous in that they eliminate most manual steps, and reduce the overall time in manufacturing the final assembly. The disclosed processes include providing a blank strip of a thin metallic member, piercing this member to prepare a plurality of apertures therethrough, profiling at least an edge region of the blank strip to provide contact precursors, forming these precursors into a predesignated configuration, plating the precursor to provide a high conductivity region thereon, and assembling the precursor with a coaxially disposed sleeve into a final contact configuration.

Accordingly, highly reliable contacts can be prepared in a fraction of the time previously required to manufacture these devices. The piercing, preforming, plating and assembling operations can be made continuously along a single manufacturing line to eliminate waste and provide more consistent tolerances.

In further aspects of this invention, the thin metallic, coaxial sleeves can be made by forming, extrusion or drawing. These sleeves are thereafter disposed around the receptacle portion of the contact bodies to both guide contact pins into the receptacle, and minimize the chances that a larger pin may inadvertently be forced into the receptacle, thus destroying the contact tolerances. Specific joining techniques are provided for crimping the sleeves onto the receptacle portion of the contact body to provide a structure which is easy to assemble, but which resists being pulled apart during installation and service. Additionally, plating techniques are provided to ensure highly reliable conductivity in the contact areas between the contact pins and contact bodies.

BRIEF DESCRIPTION OF THE DRAWINGS

The accompanying drawings illustrate preferred embodiments on the invention according to the practical application of the principles thereof, and in which.

DETAILED DESCRIPTION OF THE INVENTION

Figure 1:
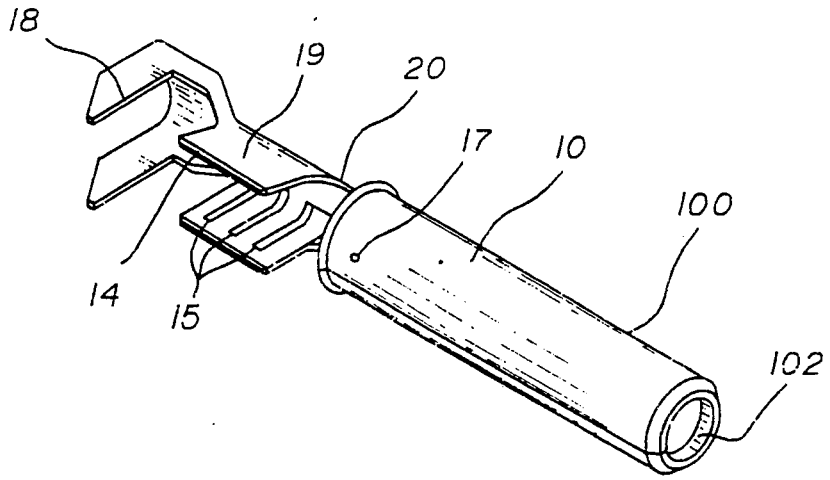
FIG. 1: is a perspective view of a preferred two-piece socket contact assembly of this invention.
Figure 2:
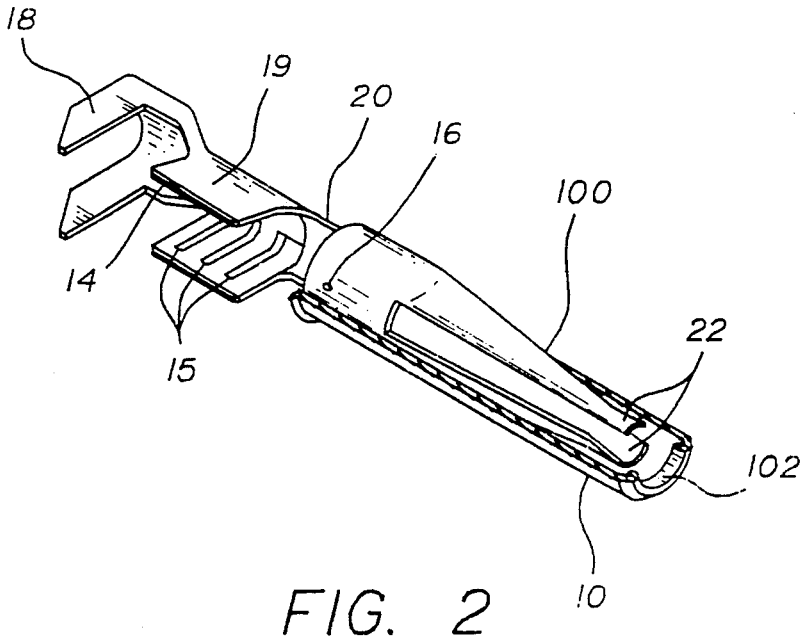
FIG. 2: is a perspective view of the preferred contact assembly of FIG. 1, in which the sleeve has been sectioned to reveal the structure of the dual cantilever beams of the contact body.
Figure 3:
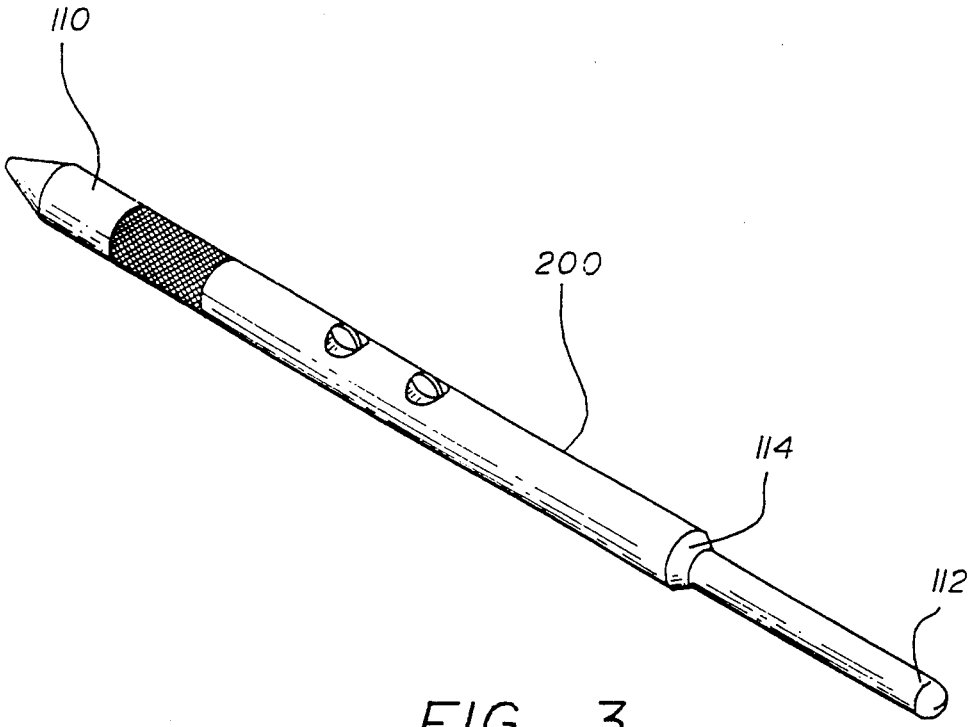
FIG. 3: is a preferred solid wire pin of this invention.

In regard to the drawings, and especially FIGS. 1–3 thereof, there is shown a two-piece socket contact assembly 100 comprising a contact body 20 and contact sleeve 10. The sleeve 10 protects the socket portion of the body from overstress and prevents damage from snagging or rough handling after termination. The sleeve 10 preferably comprises a brass or other copper-containing alloy, such as 0.226 mm thick brass Alloy 260. The sleeve 10 also may include a folded over lip portion 102 which helps to guide the mating tip 110 of the solid pin wire 200 into electrical contact and engagement with the dual cantilever beams 22 of the body 20. The folded over lip 102 ideally is sized to accept a certain range of pin sizes, and will reject oversized pins that would otherwise spread apart and potentially damage the dual cantilever beams 22, or create potential misalignment problems.

The dual cantilever beams 22 permit the required force for contact engagement to remain low, while providing electrical reliability and a normal compressive force for a service life of at least five years, and preferably at least about ten years.

In an important aspect of the contact assembly 100 of this invention, the contact body 20 is provided with a locking hole 16 during its manufacture. After application of the contact sleeve 10 over the receptacle portion of the contact body 20, the sleeve is crimped to provide crimped dimples 17 at a location which corresponds with the locking holes 16 of the body 20. This secures the sleeve 10 over the body 20 to prevent relative movement during pin insertion and handling.

The other features of the contact assembly 100 of this invention include a insulation barrel 18, and a wire barrel 19 having serrations 15 which are preferably located in a generally transverse direction along its inner surface. The insulation barrel 18 is designed to fold around the usual polymeric insulation of signal or power wires, while the wire barrel 19 is designed to crimp around, and be soldered to, the conductive portion of these wires in a tight manner. The edge of the wire barrel 19 preferably includes a swaged edge 14 for permitting the wire barrel 19 to be easily inserted into an applicator tool. The swaged edge 14 enables the applicator tool to easily crimp the wire barrel 19 around the wire portion of the signal wire and avoids misalignment and disfiguring of the wire barrel during crimping.

With respect to FIG. 3, there is shown a preferred solid wire pin 200 having a pwb ("printed wiring board") end 112 and a mating tip 110. The wire pin 200 is designed to fit snugly within the dual cantilever beams 22 of the contact body 20. Ideally both the contact portions of the cantilever beams 22 and the mating tip 110 are gold plated to ensure high electrical reliability at a minimum cost. The preferred solid wire pin 200 can be made of a copper alloy 110 of about 1 mm in diameter on the mating end 110 and about 0.75 mm in diameter at the pwb end 112. The wire pin 200 can include solder tails which are plated with a tin-lead alloy.

The entire contact area of the wire pin 200 is preferably provided with a nickel underplate to assure excellent solderability by retarding inter-metallic growth and surface oxidation. The nickel underplate also provides a barrier plate for subsequent gold plating. The mating tip 110 preferably includes a bullet-nose configuration to provide low mating forces. The wire pin 200 also may include a raised retention feature 114 for permitting the wire pin 200 to be held in a header housing, or the like, to assure uniform pin heights and distribution. Burrs and rough edges are eliminated along the solid wire pin 200 during its manufacture by tumbling and the like to prevent module contamination.

Figure 4:
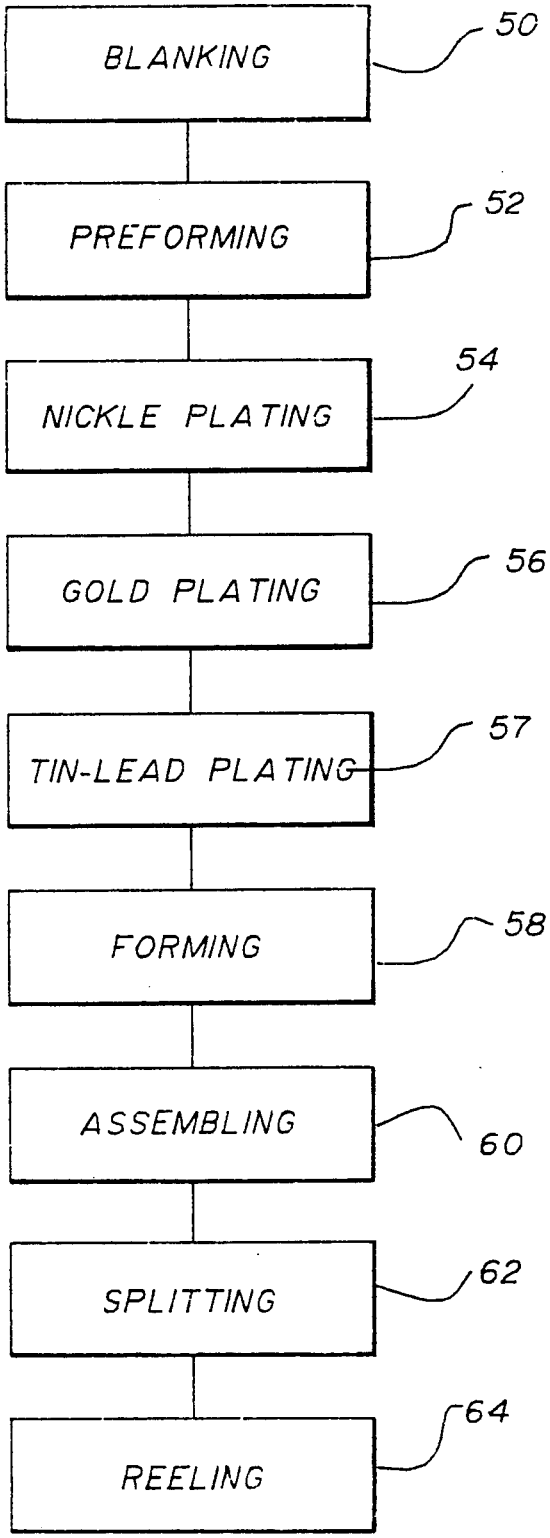
FIG. 4: is a block diagram for the preferred manufacturing sequence of the contact body of this invention.
Figure 5:
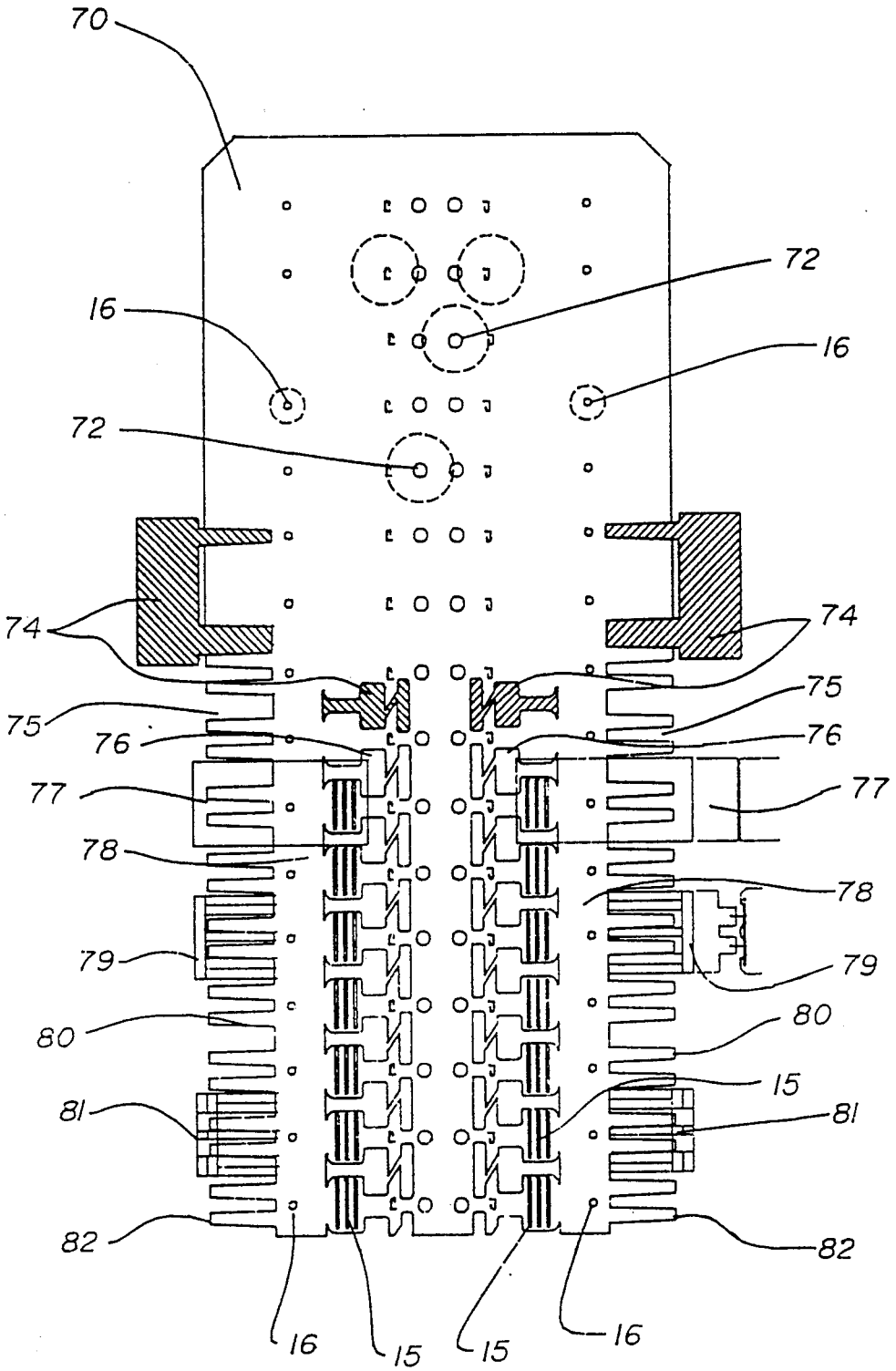
FIG. 5: is a diagrammatic processing sequence for preparing the preferred contact bodies of this invention.
Figure 6:
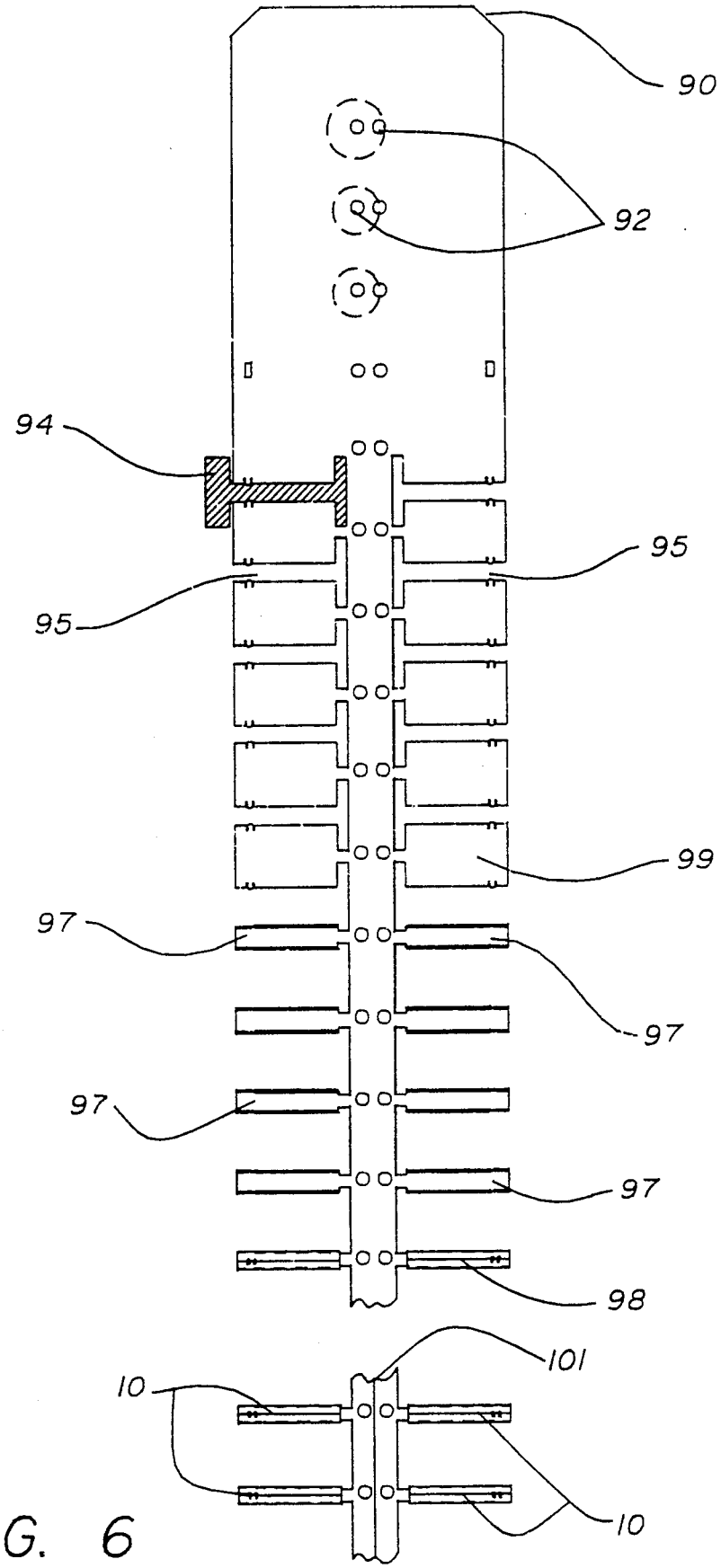
FIG. 6: is a diagrammatic preferred processing sequence for manufacturing the contact sleeves of this invention.

With respect to FIGS. 4–6, a preferred manufacturing process for preparing the contact assemblies 100 of this invention will now be disclosed. The general production sequence, described in FIG. 4, includes a blanking step 50 for providing a general connector shape and pierced holes, and a preforming step 52 for shaping the receptacle portion of the contact body 20. Plating operations are also provided, including a nickel plating step 54 for providing a tough, inter-metallic barrier plate, a gold plating step 56 for providing a highly conductive contact portion on the tips of the dual cantilever beams 22, and a tin-lead plating step 57. A final forming step 58 follows the plating operation, and is designed to provide correct beam position and barrel forming. An assembly step 60 then provides an appropriate contact sleeve along the receptacle portion of the contact body 20. Since the preferred manufacturing sequences as of this stage have created duplicate pairs of continuously processed contact assemblies, the pairs are then split at splitting step 62 and assembled onto a stock reel at reeling step 64.

A preferred manufacturing sequence for preparing the socket contact bodies 20 of this invention will now be disclosed with reference to FIG. 5. The process begins with a blank strip 70 preferably comprising about 0.12 mm thick copper alloy 7025. This material provides good conductivity, good tensile strength, and resists relaxation even at high temperatures. The blank strip 70 is initially perforated in at least two areas to form punched holes 72 and locking holes 16. After indexing the blank strip 70 to the profile machine 74, cut-out sections of the blank strip 70 are made to provide profiled spacings 75 and barrel apertures 76. The profiling step develops the rough contour and shape of the body 20, including the cantilever beams 20, and insulation and wire barrels 18 and 19.

The blank strip 70 then proceeds to a swaging and serrating machine 77 which is designed to operate on the wire barrel 19 portion of the body 20. The swaging machine 77 preferably provides a tapered or swaged edge 14 on each side of the wire barrel 19. This greatly facilitates guidance of the barrel into an appropriate applicator tool and helps to eliminate errors in the crimping operation. Serrations 15 are preferably disposed transverse to the wire barrel 19 and are designed to lock around the wire portions of inserted wires during crimping of the wire barrel 19 to prevent the wires from slipping out of the contact body 20.

Following the swaging operation, the swaged body 78 is subjected to a crescent forming machine 79 which forms a curved tip on the end of the contact body. The crescent formed body 80 then passes to a radial flaring machine 81 which forms a curved cross-section along the cantilever beam of the contact body. The radially flared contact body portions 82 are thereafter ready for plating.

In a preferred plating procedure of this invention, the blank strip 70, including radially flared bodies 82 is passed through a plating strip line containing, in sequential tanks, a nickel barrier plating solution, a gold plating solution, and a tin-lead plating solution. The blank strip is first passed through a plating solution which provides a nickel plate at least along the dual cantilever beams 22, or the receptacle portion of the body. Thereafter, the inside tip portions of the cantilever beams 22 are gold plated to provide a highly reliable electrical contact. Finally, a thin tinning layer is provided at least along the wire barrel 19. The various plating operations of this invention can be provided by both electrolytic and electroless plating techniques, but also may be applied by vapor deposition or other metal transfer methods known to those in the art. Although plating could be accomplished prior to forming the body portions, this step is desirably conducted after forming, so that the sensitive plating layers are not damaged by the forming die.

Following plating, the now plated, radially flared contact bodies are passed through a combined barrel forming and beam positioning operation which (1) prepares the wire barrel 19 and insulation barrel 18 for later use in crimping operations, and (2) carefully folds the two portions of the cantilever beams 22 to form a socket receptacle. The body 20 is then substantially complete and merely requires insertion into an acceptable sleeve 10.

The sleeve 10 is preferably mechanically applied to the dual cantilever beams 22 and crimped with one or more crimped dimples 17 over the locking hole 16 in the contact body 20. The now fully assembled contact assemblies 100 can then be split along the central line of the blank strip 70 and reeled onto a storage reel for later use in connector assemblies.

The preferred contact sleeves 10 of this invention can be fabricated by a number of different ways, including deep drawing, extrusion, and blank forming operations. With respect to FIG. 6, there is shown a preferred blank forming operation for preparing the sleeves 10 of this invention. A blank strip 90 preferably is made of copper or brass, and is subjected to a piercing operation in which punched holes 92 are provided through its thickness. The blank strip 90 is then passed through a profiling machine 94 which creates profiled spacings 95 along selected portions of the blank strip 90. The individual cutout sections are then subjected to a swaging operation which provides a swaged front to facilitate the forming of the folded over lip 102. The preforms 99 are then subjected to a U-ing die which creates U-ed preforms 97. The U-ed preforms 97 are then subjected to a rolling operation to provide rolled sleeves 98. The blank strip 90 can then be provided with a severable slit 101 along its central axis. Following severing from the remainder of the blank, each sleeve 10 is inserted around a corresponding receptacle portion of a contact body 20, and crimped in place.

In a more preferred procedure, the sleeves 10 are provided by a deep drawing operation. The drawing operation begins with a thin strip of copper, brass, or other copper alloy which is shaped by a drawing piston to conform to the interior of a die having the preferred outer dimensions of the contact sleeve 10. Similarly, the sleeves 10 can be provided by extrusion and a subsequent cutting step to provide sleeves 10 of uniform tubular dimensions. With either process, the extruded or drawn pieces can be fed into a bowl feeder or the like, which distributes them to a shuttle station for insertion over the receptacle portion of the preferred bodies 20. Following insertion, the sleeves 10 can be crimped in the same manner as suggested earlier.

Extruded or drawn contact sleeves have the added advantage of being seamless. Since it is known that end users of the contact assemblies of this invention may occasionally insert a pin of a greater diameter than the inner-diameter of the sleeves 10, a seamless product has the advantage of not having a weak seam that may open upon forceful insertion of a larger pin. Accordingly, a better guarantee against inadvertent insertion is provided by extruded and drawn contact sleeves.

From the foregoing, it can be realized that this invention provides highly reliable contact assemblies and more efficient manufacturing methods for producing them. Although various embodiments have been illustrated, this was for the purpose of describing, and not limiting the invention. Various modifications, which will become apparent to one skilled in the art, are within the scope of this invention described in the attached claims.

What is claimed is:

1. A continuous process for manufacturing contact assemblies, comprising:

providing a blank strip of indefinite length;

piercing said strip to provide a plurality of apertures therein;

profiling a contact body shape at least along an edge portion of said blank strip to form precursors of said contact bodies;

forming said precursors into a predetermined configuration;

plating a portion of said contact body precursors to provide a high conductivity portion thereon; and assembling said contact body precursors with a coaxially disposed contact sleeve, wherein the piercing, profiling, forming, plating and assembling are performed along a single manufacturing line.

2. The method of claim 1, wherein said contact sleeve comprises a rolled blank.

3. The method of claim 1, wherein said contact sleeve comprises an extruded or drawn tubular member.

4. The method of claim 1, wherein said plating step occurs after said forming step.

5. The method of claim 1, wherein said piercing step provides at least one locking hole for enabling said sleeve to be crimped in mechanical locking arrangement to said contact body.

6. The method of claim 1, wherein said piercing step comprises providing spaced apertures along a transverse side of said blank strip.

7. The method of claim 6, wherein said profiling step further comprises providing an aperture through said blank for roughly defining a barrel configuration.

8. The method of claim 1, wherein said forming step comprises shaping said contact body precursors with at least two dies.

9. The method of claim 8, wherein said dies comprise a forming die and a serrating die.

10. The method of claim 1, wherein said assembly step comprises folding said contact body precursors to form a pair of socket cantilever beams.

11. A continuous process for manufacturing an electrical contact comprising:

providing a blank strip;

piercing a linear array of pierced holes through said blank strip;

profiling said blank strip to provide a connector contact body precursor, including a barrel portion and a receptacle portion thereon;

serrating said barrel portion to provide gripping serration thereon;

performing said receptacle portion of said contact body precursor to form a desired configuration;

plating a portion of said contact body precursor to provide a high conductivity surface thereon; and assembling said connector contact body precursor with a coaxial sleeve disposed around said receptacle portion to provide a two piece socket contact assembly, wherein the piercing, profiling, forming, plating and assembling are performed along a single manufacturing line.

12. The method of claim 11, wherein said profiling step comprises providing a plurality of integrally connected, connector contact precursors, said precursors including a pair of extended cantilever beams.

13. The method of claim 12, wherein said serrating step comprises disposing a plurality of serrations along said barrel portion.

14. The method of claim 13, wherein said plating step comprises disposing a nickel-containing layer followed by a gold-containing layer onto said contact body precursor.

15. The method of claim 14, wherein said assembly step comprises crimping said coaxial sleeve to form a mechanical lock with said contact body.

* * * * *